US005368692A

United States Patent [19]

Derrick

[11] Patent Number: 5,368,692

[45] Date of Patent: Nov. 29, 1994

[54] METHOD FOR CONTROLLING PITCH

[75] Inventor: Arthur P. Derrick, New South Wales, Australia

[73] Assignee: Vinings Industries Inc., Atlanta, Ga.

[21] Appl. No.: 99,219

[22] Filed: Jul. 29, 1993

Related U.S. Application Data

[63] Continuation-in-part of Ser. No. 823,826, Jan. 22, 1992, abandoned.

[51] Int. Cl.[5] ..... D21H 17/34

[52] U.S. Cl. ..... 162/181.8; 162/DIG. 4

[58] Field of Search ..... 162/199, 181.3, 181.8, 162/164.6, 168.2, DIG. 4

[56] References Cited

U.S. PATENT DOCUMENTS 4,913,775 4/1990 Langley et al. ..... 162/168.2

4,964,955 10/1990 Lamar et al. ..... 162/181.8

5,032,227 7/1991 Derrick ..... 162/168.1

*Primary Examiner*—W. Gary Jones

*Assistant Examiner*—Brenda Adih Lamb

*Attorney, Agent, or Firm*—Kane, Dalsimer, Sullivan, Kurucz, Levy, Eisele and Richard

[57] ABSTRACT

A method for the control of pitch in a pulp is characterized in that the method comprises sequentially adding to and mixing with the pulp (1) 1-10 Kg/tonne of pulp of a low molecular weight, high cationic charge, polymeric, water-soluble species, such as those derived from inorganic aluminium salts or quaternary polyamines, and (2) 0.5 to less than 10 Kg/tonne of pulp of montmorillonite clay particles, such as bentonite, which clay particles may be chemically modified to improve adsorption capacity or otherwise treated to increase the anionic charge density of the dispersion but which do not have a water-soluble cationic polymer associated therewith.

11 Claims, No Drawings

METHOD FOR CONTROLLING PITCH

CROSS-REFERENCE TO RELATED APPLICATION

This application is a continuation-in-part of my copending U.S. patent application Ser. No. 07/823,826 filed on Jan. 22, 1992 now abandoned.

BACKGROUND OF THE INVENTION

1. Field of the Invention

This invention concerns a method of controlling pitch in pulps for use in making paper. More particularly, this invention concerns a method of controlling the buildup of pitch on equipment used for pulping and the improved dispersion of pitch in pulps.

2. Brief Description of the Related Art

Pitch, carried over from wood or bark pulped to make papermaking furnishes, is formed of a complex mixture of oleophilic, water insoluble, low molecular weight, essentially non-polar resins comprising fatty and resin acids with ionisable hydrophillic groups, fatty and resin acid esters, sterols, di and tri-glycerides, terpenes and waxes and various alcohols, hydrocarbons and neutral compounds associated with these resins. The resins tend to agglomerate to form sticky films or pitch balls, which in turn can give rise to spotting in the final paper product, wire spots, localised sticky spots on rolls, holes in the paper sheet, poor paper formation, felt plugging or sticking on dryer and calender rolls.

Effective pitch control, particularly in paper mills which produce paper from groundwood, thermomechanical and semi-chemical pulps, has traditionally been difficult. The important parameters for pitch control are elegantly summarised in U.S. Pat. No. 4,964,955 as follows:

"To control pitch effectively it is not necessary to remove all of the pitch from the pulp. Different types of pulp mills have different tolerance levels for pitch particles which must be exceeded before pitch caused problems occur. What is necessary, however, is that the pitch be dispersed as tiny non-harmful aggregated or agglomerated particles and retained in this fine particulateform rather than as larger harmful globs in the paper sheet. Simply flocculating pitch will not give good pitch control; the pitch must be made to attach to either the cellulosic fibres or to any particulate matter used as filler in the paper sheet, or preferably to both. Pitch retained in large flocs causes breaks and undesirable dark specks in the finished paper sheet, while pitch not retained but in small flocs tends to accumulate in the papermaking facility's white water system".

Efforts to control pitch deposit problems by dispersing or precipitating the pitch have traditionally involved the use of alum salts; ultrafine crystalline talc; anionic, cationic and non-ionic dispersants, polymeric retention aids and mixtures of these materials. More recently, water soluble zirconium salt complexes and organotitanium chemicals have been suggested as pitch control agents.

Papermakers alum ($Al_2(SO_4)_3$-$14H_2O$), liquid sodium aluminate (20–25.5% $Al_2O_3$) and polyaluminium chloride are the primary alumina sources used for pitch control. Above pH 3 hydrolysis of the salts occur and a variety of hydroxy-aluminium complexes are formed depending upon the hydroxide ion concentration. Hydroxyl bridging occurs forming dimers and higher order polymer species (ligands). The formation of these desirable short chain relatively low molecular weight polymer species is primarily influenced by the system pH, temperature (the higher the better), the concentration of aluminium ions and the cationic demand of the stock. In pitch control, the optimum pH is preferably around 4.5 although in practice an operating range of 4.0–5.5 is fairly typical. It is believed that pitch control with aluminium salts is a combination of a flocculation mechanism, where the pitch particles are entrapped by the polymeric aluminostructure, and the formation of a cationic complex with the resin and fatty acid components of the pitch, which in turn is then adsorbed onto the pulp fibres. A sodium aluminate/alum combination is generally preferred because there is no need for caustic soda to be used to control pH, it minimises sulphate ion build up in closed white water systems and it limits iron contamination thus making it easier to meet brightness specifications. Typical consumption figures are: alum 5–25 Kg/tonne and 45% sodium aluminate 5–10 Kg/tonne.

Ultrafine talc with a surface area of from 10 to 15 $m^2$/gm has been used for pitch control in pulp paper mills and in particular in those mills that are processing Kraft or sulphite pulps, i.e. where the pitch is present in a partially saponified state. The dispersed pitch particles are adsorbed on to the hydrophobic talc platelets and then retained in the paper. Typically, a use rate of 10–40 Kg/tonne is required.

A wide range of surfactants and short chain polymeric dispersants have been used to maintain pitch in a dispersed state within the paper making circuit. These dispersants function by charge and/or steric hinderance mechanisms. Anionic dispersants, such as lignin sulphonates, polynaphthalene sulphonates and polyacrylates, increase the electronegative charge on the pitch particles, i.e. they peptize the pitch particles and inhibit agglomeration. Nonionic surfactants result in steric repulsion of the pitch and depending on the type and concentration can soften and emulsify pitch deposits already formed. Since dispersants do not attach the pitch to the pulp fibres, they have limited use in controlling severe pitch problems such as is generated in TMP mills. An excess of dispersant can result in a substantial build up in the concentration of pitch in closed white water systems. Usage rates for pitch dispersants are typically in the range of 5–100 ppm on the stock.

The use of polyquaternary ammonium polymers for pitch control has been promoted in recent years. The control mechanism is described by T. Hassler, Tappi Journal, June 1988, p 195 onwards. The low molecular weight cationic polymers which are commercially available are believed to be linear and/or partially crosslinked polydiallyldimethyl ammonium chloride (polyDADMAC) and copolymers of epichlorohydrin and short chain aliphatic secondary amines. A typical use rate would be from 1.25–2.3 Kg/tonne.

The use of current retention and drainage aid technologies e.g. "Lapotain" (Laporte Industries Limited), "Composil" (Eka-Nobel) and -Positek- (Nalco Chemical Co) etc, give significant improvements in pitch control on the machines, but reliance on this type of technology however is only possible when the mill can justify a retention and drainage aid programme.

More recently, a method of reducing pitch in pulping and papermaking operations by a process which comprises (1) adding to a pitch-containing furnish a particulate composite substance comprising (a) a water soluble cationic polymer adsorbed onto (b) an essentially water insoluble particulate substrate carrying an anionic charge, and (2) adsorbing pitch onto said composite to form discrete. finely dispersed pitch-containg aggregates in the furnish, is disclosed in U.S. Pat. No. 4,964,955. On Column 8, line 67, to Column 9, line 15, of the U.S. patent, it is disclosed that any essentially water-insoluble particulate organic or inorganic substance may be employed as the substrate, including phyllosilicate minerals, kaolin, talc, mica, montmorillonite, chlorite and pseudolayer silicates, though Kaolin is particularly preferred. Indeed, this preferrence is clearly demonstrated in the examples in that Kaolin is the only substrate exemplified. It is demonstrated in Examples IV to VI, IX and X that improved pitch control may be achieved by pretreating a groundwood pulp with alum prior to treatment with a cationic kaolin. In Example XII, on Column 19, lines 12 to 16, it is disclosed that using 60–80 lbs/ton of cationic kaolin slurry with 35 lbs/ton of alum will essentially eliminate all pitch. From a practical point of view, however, the amount of cationic kaolin required in the process tends to make a papermaking process uneconomic. A similar method is disclosed in EP-A-0349311.

Japanese patent application No 62-245908 discloses a method for reinforcing paper strength by adding bentonite to a pulp after a cationic paper strength reinforcing agent has been mixed in the pulp. It is noted in the patent application that the process, apart from improving the paper strength, also solves pitch troubles. It is disclosed in Example 1 and Example 2 that a minimum of 10 Kg/tonne (1% relative to pulp) of bentonite was added to a pulp which had been previously treated with reinforcing agent and alum. Whilst this method appears suitable for improving paper strength, retention and pitch problems, as a method for controlling pitch alone, this process would tend to be uneconomic.

It is an object of the present invention to provide a process for controlling pitch in pulps, which process is technically at least as efficient at eliminating or reducing pitch in pulps as the process described in U.S. Pat. No. 4,964,955 but which is economically more acceptable.

SUMMARY OF THE INVENTION

In accordance with the present invention, there is provided a method for the control of pitch in a pulp and is characterised in that the method comprises sequentially adding to and mixing with the pulp while in a thick stock stage (1) 1–10 Kg/tonne of pulp dry solids of a low molecular weight, high cationic charge, polymeric, water-soluble species and (2) 0.5–<10 Kg/tonne of pulp dry solids of montmorillonite clay particles, which clay particles do not have a water-soluble cationic polymer adsorbed thereon.

The low molecular weight, high cationic charge, polymeric, watersoluble species may be organic but is preferably inorganic and is preferably present in an amount of 2 to 6 Kg/Tonne of pulp. The polymeric species has a low molecular weight, preferably below 1 million and more preferably below 0.5 million.

If an organic species is used, it is preferably a polymer of the type disclosed on column 9, line 50, to column 10, line 34, of U.S. Pat. No. 4,964,955. The polymer preferably has a cationic charge density of at least 5 m.eq/gm, preferably a charge density of from 6 to 7 m.eq./g or more. Preferably, the polymer is not a Mannich polymer.

If an inorganic species is used, it is preferably papermakers alum, sodium aluminate, poly aluminium chloride, poly aluminium silicate or an other inorganic water soluble salt of aluminium. Preferably sodium aluminate is used in the present invention.

DETAILED DESCRIPTION OF THE INVENTION

Montmorillonite clays are distinguished by their ability to be water swellable. Synthetic water swellable clays, such as Laponite (Laporte Industries Limited) , are understood to have similar properties to montmorillonite clays and are therefore included within the scope of the present invention. Bentonire is the preferred montmorillonite. Preferably, the amount of montmorillonite added to the pulp is from about 1 Kg/Tonne to less than 10 Kg/Tonne, more preferably from about 2 Kg/Tonne to about 5 Kg/Tonne.

Whilst for cost purposes it is preferred to use bentonite which has not been chemically modified in any way, in some instances it may be technically preferrable to employ a bentonite which has been chemically modified, e.g. by alkali treatment to convert calcium bentonite substantially to alkali (e.g. sodium, potassium or ammonium) bentonite, or a bentonite in intimate association with a water soluble, highly charged anionic polymer, e.g. Lapotain available from Laporte Industries Limited.

Preferably, the pulp contains less than 0.15% polyacrylamide which has been submitted to a Mannich reaction and preferably the. pulp contains no such polymer.

The order of addition of the components to the pulp is not important in achieving the advantages of the present invention; component (1) may be added after component (2), though it is preferred to add component (1) before component (2). It is important, however, that in any event, the first component added to the pulp must be thoroughly mixed into the pulp before the second component is added. Mixing may be achieved by subjecting the pulp to high shear conditions, such as by passing the pulp through a centriscreen or through mixing pumps or fan pumps, though simple turbulence mixing obtainable by passing the pulp along a length of pipeline may be just as effective.

The process of the present invention has a number of advantages over the the process described in U.S. Pat. No. 4,964,955, including the surprising fact that the process of the present invention has improved pitch control over the process of the prior art. Other advantages, including the obvious cost advantage, will be immediately apparent to a person skilled in the art.

The invention will now be further described, without limitation, by reference to the examples set forth below.

EXAMPLES

Samples of a virgin TMP pulp, obtained from a major pulp/paper manufacturer located in the south east of U.S.A., were used in the following examples. The pulp was selected on the basis that southern pine pulps from this part of U.S.A. may contain significant concentrations of troublesome pitch (It should be appreciated that comparison of one series of results obtained from one pulp sample cannot be compared with the series of results obtained from a different pulp sample).

In each evaluation, the thick stock samples, taken from either the refiner or the latency stock chest, were diluted and aged at 180° F. with tap water processed through a laboratory scale disintegrator and adjusted to 1% consistency.

The samples were subjected to the colloidal dispersed solids test (CDS) the procedure of which involves 1. Pulp stock samples (after treatment) are sieved through a 60 mesh screen, the resulting low solids solution is placed in 50 ml or 100 ml centrifuge tubes and spun for 30 mins. at 4000 rpm.

2. The supernatent is carefully removed by syringe and transferred into a small bottle (need approx 60 mls of supernatent)

3. A suitable aliquot is then transferred to tared beaker. It is recommended that a minimum of 25 gms of liquid should be filtered. Care is necessary to prevent any extraneous material contaminating the beaker.

4. Record the weight of the sample taken using a 2 decimal place balance.

5. The liquid sample is then filtered through a previously dried, dessicated and weighed 0.45 micron millipore filter using maximum vacuum. The filter is previously "wet out" with distilled water.

6. After the fluid has completely drained, remove the filter pad, dry at 50° C. for 15 mins, dessicate and reweigh using 4 decimal place balance.

7. Record this weight.

The weight of the filter and solids minus the weight of the filter is equal to the weight of colloidal dispersed solids (CDS)

$$\frac{\text{Weight of colloidal dispersed solids}}{\text{Weight of supernatent liquid taken}} \times 10^6 = \text{ppm } CDS$$

This test procedure has good correlation with the prediction of pitch problems in operating newsprint and linerboard mills. CDS measurements also correlate well with microscopic pitch counting procedures as described in Pitch Particle Concentration: an Important Parameter in Pitch Problems by L. H. Allen, Pulp & PaperResearch Institute of Canada, Pointe Claire, Que, pl-9.

PITCH ADSORPTION RESULTS

| Optimisation Series I | Selected Components |
|---|---|
| Stock consistency | 0.62% |
| pH | 4.8 |
| Blank C.D.S | 98 ppm |

| Chemical | Dose Rate kg/tone | Reduction In CDS (Pitch) |
|---|---|---|
| Alum (17% $A_2O_3$) System adjusted to pH 5.3 | 5 | 25 |
| Alum (17% $A_2O_3$) System adjusted to pH 5.3 | 10 | 27 |
| Alum (17% $A_2O_3$) System adjusted to pH 5.3 | 25 | 88 |
| 'Proset' 1820 | 1 | 16 |
| 'Proset' 1820 | 2 | 35 |
| 'Proset' 1820 | 4 | 57 |
| Polymin SK | 1 | — |
| Polymin SK | 2 | 31 |
| Polymin SK | 4 | 53 |

| Chemical | Dose Rate kg/tone | % Reduction In CDS (Pitch) |
|---|---|---|
| PolyDADMAC | 1 | 20 |
| PolyDADMAC | 2 | 47 |
| PolyDADMAC | 4 | 61 |
| Southern Clay SCPX 572 | 3 | 43 |
| Southern Clay | 5 | 63 |

-continued

PITCH ADSORPTION RESULTS

| Optimisation Series I | Selected Components |
|---|---|
| Stock consistency | 0.62% |
| pH | 4.8 |
| Blank C.D.S | 98 ppm |

| | | |
|---|---|---|
| SCPX 572 Southern Clay | 10 | 92 |
| SCPX 572 Southern Clay | 20 | 96 |
| SCPX 572 Fulgel 300/2 | 3 | 61 |
| Fulgel 300/2 | 5 | 78 |
| Fulgel 300/2 | 10 | 80 |
| Fulgel 300/2 | 20 | 84 |

OPTIMISATION SERIES II

| | |
|---|---|
| Stock-Consistency | 0.65% |
| pH | 4.9 |
| Blank CDS | 121 ppm |

| Chemical | Dose Rate kg/tonne | % Reduction In CDS (Pitch) |
|---|---|---|
| Activity of Simple Components | | |
| A. Cationic Components | | |
| VSA 45 - pH of System adjusted to 5.3 | 3 | 34 |
| VSA 45 - pH of System adjusted to 5.3 | 5 | 42 |
| Alum (17% $Al_2O_3$) pH adjustment to 5.3 | 3 | 22 |
| Alum (17% $Al_2O_3$) pH adjustment to 5.3 | 5 | 27 |
| PAC (17% $Al_2O_3$) pH adjustment to 5.2 | 3 | 22 |
| PAC (17% $Al_2O_3$) pH adjustment to 5.2 | 5 | 30 |
| 'Proset' 2830 | 0.5 | 21 |
| 'Proset' 2830 | 1.0 | 51 |
| B. Bentonite substrate Components (Preferred) | | |
| "GADORGEL" X | 2 | 13 |
| "GADORGEL" X | 3 | 16 |
| "GADORGEL" X | 5 | 23 |
| "FULGEL" 300 | 2 | 16 |
| "FULGEL" 300 | 3 | 29 |
| "FULGEL" 300 | 5 | 43 |
| SCPX590 | 2 | 20 |
| SCPX590 | 3 | 26 |
| SCPX590 | 5 | 36 |
| SCPX592 | 2 | 14 |
| SCPX592 | 3 | 22 |
| SCPX592 | 5 | 27 |
| SCPX590/2 | 3 | 29 |
| SCPX590/2 | 5 | 37 |
| SCPX592/2 | 3 | 30 |
| SCPX592/2 | 5 | 42 |

Note:
SCPX-/2 Substrates are the basic bentonite modified with 2% */W Accumer 9000 (available from Rohm and Haas Co) in solids Optimisation Series III

| | |
|---|---|
| Stock-Consistency | 0.66% |
| pH | 4.8 |
| Blank CDS | 133–134 ppm |

| Chemical Programme | Dose Rate of Components kg/tonne | % Reduction In CDS (Pitch) |
|---|---|---|
| VAS 45/'Fulgel' 300 pH to 5.3 After VSA addition | 3/2 | 20 |
| VAS 45/'Fulgel' 300 pH to 5.3 After VSA addition | 5/2 | 90 |
| VAS 45/'Fulgel' 300 pH to 5.3 After VSA | 3/3 | 23 |

-continued

Optimisation Series III

| | | |
|---|---|---|
| Stock-Consistency | 0.66% | |
| pH | 4.8 | |
| Blank CDS | 133–134 ppm | |
| addition | | |
| VAS 45/'Fulgel' 300 | 5/3 | 87 |
| pH to 5.3 After VSA addition | | |
| VSA 45 Alone | 5 | 74 |
| pH to 5.3 | | |
| VSA 45/Fulgel 300/2 | 3/2 | 12 |
| pH to 5.3 After VSA addition | | |
| VSA 45/Fulgel 300/2 | 5/2 | 45 |
| pH to 5.3 After VSA addition | | |
| VSA 45/Fulgel 300/2 | 3/3 | 17 |
| pH to 5.3 After VSA addition | | |
| VSA 45/Fulgel 300/2 | 5/3 | 73 |
| pH to 5.3 After VSA addition | | |
| Fulgel 300/2/VSA 45 | 2/3 | 27 |
| ie Reverse Addition | | |
| 'Proset' 2830/'Fulgel' 300 | 0.5/2 | 24 |
| 'Proset' 2830/'Fulgel' 300 | 1/2 | 43 |
| 'Proset' 2830/'Fulgel' 300 | 0.5/3 | 31 |
| 'Proset' 2830/'Fulgel' 300 | 1/3 | 46 |
| 'Proset' 2830/'Fulgel' 300 | 1/5 | 49 |
| 'Proset' 2830 Alone | 0.5 | 20 |
| 'Proset' 2830 Alone | 1.0 | 33 |
| 'Proset' 2930/'Fulgel' 300/2 | 0.5/2 | 22 |
| 'Proset' 2930/'Fulgel' 300/2 | 1/2 | 33 |
| 'Proset' 2930/'Fulgel' 300/2 | 0.5/3 | 20 |
| 'Proset' 2930/'Fulgel' 300/2 | 1/3 | 32 |
| Alum Alone (17% $Al_2O_3$) | 5 | 22 |
| pH adjusted to 5.3 | | |
| Alum/'Fulgel' 300 | 5/3 | 33 |
| Alum/'Fulgel' 300 | 5/5 | 42 |
| Alum/'Fulgel' 300/2 | 5/3 | 28 |

-continued

Optimisation Series III

| | | |
|---|---|---|
| Stock-Consistency | 0.66% | |
| pH | 4.8 | |
| Blank CDS | 133–134 ppm | |
| Alum/'Fulgel' 300/2 | 5/5 | 16 |
| Alum @ Equivalent $Al_2O_3$ to VSA 45 + SCPX 572 | 7.5/5 | 55 |

| Chemical | Dose Rate of Components kg/tonne | % Reduction In CDS (Pitch) |
|---|---|---|
| VSA 45 Alone pH to 5.3 | 5 | 72 |
| VSA 45/SCPX 572 | 5/3 | 83 |
| VSA 45/SCPX 572 | 5/5 | 87 |
| VSA 45/SCPX 572/2 | 5/3 | 67 |
| VSA 45/SCPX 572/2 | 5/5 | 73 |
| 'Proset' 2830/SCPX 572 | 1/3 | 53 |
| 'Proset' 2830/SCPX 572 | 1/5 | 57 |
| 'Proset' 2830/SCPX 572/2 | 1/3 | 35 |
| 'Proset' 2830/SCPX 572/2 | 1/5 | 38 |

| Stock Sample | Consistency | 0.9% |
|---|---|---|
| | pH | 4.8 |
| | Blank CDS | 158 ppm |

| Chemical | Concentration Dose Rate of Components kg/tonne | % Reduction In CDS (Pitch) |
|---|---|---|
| VSA 45 (alone) | 5 | 43 |
| VSA 45/SCPX 590 | 5/5 | 71 |
| 'Proset' 2830 (alone) | 1 | 29 |
| 'Proset' 2830 (alone) | 1.5 | 75 |
| 'Proset' 2830/SCPX 590 | 1/5 | 77 |
| 'Proset' 2830/SCPX 590 | 1.5/5 | 94 |

PITCH ADSORPTION ACTIVITY:

| PAC/PAC & ACCOFLOC HCX @ 5 Kg/t | % Reduction in CDS ('PITCH') | ACCOFLOC HXC/HCX & PROSET 2830 @ 2 Kg/t | Reduction in CDS ('PITCH') |
|---|---|---|---|
| PAC @ 5 Kg/t | 44 | HCX @ 3 Kg/t | 20 |
| PAC @ 10 Kg/t | 44 | HCX @ 5 Kg/t | 45 |
| PAC @ 25 Kg/t | 97 | HCX @ 10 kG/T | 54 |
| PAC @ 5 Kg/t & HCX | 60 | HCX @ 20 Kg/t | 73 |
| PAC @ 10 Kg/t & HCX | 72 | HCX @ 3 Kg/t & P2830 | 88 |
| PAC @ 25 Kg/t & HCX | 98 | HCX @ 5 Kg/t & P2830 | 91 |
| | | HCX @ 10 Kg/t & P2830 | 96 |
| | | HCX @ 20 Kg/t & P2830 | 95 |

| PROSET 2830/P2830 & IICX/P2830 & GADORGEL X (HCX & CA ORGEL @ 5 Kg/t) | % Reduction in CDS ('PITCH') | CLAY SUBSTRATES @ 10 Kg/t | % Reduction in CDS ('PITCH') |
|---|---|---|---|
| PROSET 2830 @ 1 Kg/t | 58 | FULBOND X | 53 |
| PROSET 2830 @ 2 Kg/t | 82 | GADORGEL X | 60 |
| PROSET 2830 @ 4 Kg/t | 96 | AX SAPONITE | 59 |
| P2830 @ 1 Kg/t & HCX | 77 | ACCOFLOC HCX | 59 |
| P2830 @ 2 Kg/t & HCX | 87 | FULGEL 300 | 59 |
| P2830 @ 4 Kg/t & HCX | 97 | | |

-continued

PITCH ADSORPTION ACTIVITY:

| | | |
|---|---|---|
| P2830 @ 1 Kg/t | GADORGEL | 60 |
| P2830 @ 2 Kg/t | GADORGEL | 88 |
| P2830 @ 4 Kg/t | GADORGEL | 95 |

| PROSET 2830 @ 2 Kg/t & CLAY SUBSTRATES @ 5 Kg/t | % Reduction in CDS ('PITCH') | PROSET 2830 @ 1 Kg/t & CLAY SUBSTRATES @ 5 Kg/t | % Reduction in CDS ('PITCH') |
|---|---|---|---|
| P2830 only | 82 | P2830 only | 58 |
| P2830 & HCX | 87 | P2830 & HCX | 77 |
| P2830 & GADORGEL X | 88 | P2830 & GADORGEL X | 60 |
| P2830 & GADORGEL X/2 | 91 | P2830 & GADORGEL X/2 | 94 |
| P2830 & FULGEL 300 | 100 | P2830 & FULGEL 300 | 94 |
| P2830 & FULGEL 300/2 | 97 | P2830 & FULGEL 300/2 | 81 |

The performance of the process of the present invention was compared with the process described in U.S. Pat. No. 4,964,955. A 2 gm per liter dispersion of SCPX 572 bentonite was modified by reacting with a dilute solution (2%) of a polyDADMAC product. The Zeta potential of the composite material was measured at 40 mv on a Matec Applied Sciences Electrokinetic Sonic Analysis System. The ratio of cationic polymer to bentonite was used to produce a 7 g/l total actives dispersion for testing. The results were as follows.

| Stock Sample | |
|---|---|
| Consistency | 0.9% (100% TMP) |
| pH | 4.8 |
| Blank CDS Concentration | 158 ppm |

| Chemical Programme | Dose Rate of Components kg/tonne | % Reduction in CDS (Pitch) |
|---|---|---|
| SCPX 572 Bentonite Cation Modified | 10 | 67 |
| SCPX 572 Bentonite Cation Modified | 10 | 68 |
| SCPX572 Bentonite Poly DADMAC @ 4 kg/tonne followed by SCOX572 Bentonite @ 10 kg. tonne | 14 | 82 |
| Alum (17% $Al_2O_3$) System adjusted to pH 5.3 | 4/10 | 81 |
| Alum followed by SCPX572 Bentonite | 5 | 37 |
| Alum followed by Cation modified SCPX572 Bentonite | 5/10 | 85 |
| | 5/10 | 90 |

Note
All concentrations are expressed as 100% Active Materials

As can be seen from the results, the cation modified bentonite demonstrates substantially no advantage over the normal anionic charge bentonite at equivalent use rates. This result is technically most surprising and clearly demonstrates the commercial advantage of the present invention.

The following trade marks, which may be registered trade marks, have been used in the Examples:

PROSET 1820 is an epichlorohydrindimethylamine polymer available from Vinings Industries Inc.

POLYMIN SK is a polyamidoamine available from BASF

SCPX 572 is a high swelling bentonite clay available from Southern Clay Products Fulgel 300/2 is an anionically modified bentonite available from Laporte Industries Limited VSA 45 is a 45% sodium aluminate solution available from Vinings Industries Inc PAC is polyaluminium chloride PROSET 2830 is an epichlorohydrindimethylamine crosslinked with a shori chain aliphatic amine available from Vinings Industries Inc GADORGEL is a high swelling bentonite clay available from Laporte Industries Ltd FULGEL 300 id a high swelling bentonite clay available from Laporte Industries Ltd SCPX 590 is a high swelling bentonite clay available from Southern Clay Products SCPX 592 is a high swelling bentonite clay modified with a low molecular weight anionic polymer available from Southern Clay Products SCPX 590/2 is a bentonite clay modified with anionic polymer available from Southern Clay Products SCPX 592/2 is a bentonite clay modified with an anionic polymer available from Southern Clay Products ACCOFLOC HCX is an hectorite clay available from American Colloids Inc.

I claim:

1. A method for the control of pitch in a papermaking pulp, which comprises; sequentially adding to and mixing with the pulp while in a thick stock stage (a) from 1–10 Kg/ton of pulp dry solids, of a low molecular weight, high cationic charge, polymeric water-soluble species; and (b) from 0.5 to less than 10 Kg/ton of pulp dry solids, of montmorillonite clay particles, said clay particles not having a water-soluble cationic polymer absorbed thereon.

2. A method as claimed in claim 1, wherein the montmorillonite clay is bentonite.

3. A method as claimed in claim 1, wherein the amount of montmorillonite added to the pulp is from about 1 Kg/Ton to about 5 kg Ton.

4. A method as claimed in claim 1, wherein the montmorillonite clay is bentonite which has been chemically modified by alkali treatment to convert said bentonite substantially to a member selected from the group consisting of sodium, potassium or ammonium bentonite.

5. A method as claimed in claim 1, wherein the amount of said species added to the pulp is from about 2 Kg/ton to about 6 Kg/Ton.

6. A method as claimed in claim 1, wherein said species is an organic polymer having a charge density of at least 5 m.eq./g.

7. A method as claimed in claim 1, wherein said species is an inorganic polymer selected from the group consisting of papermakers alum, sodium aluminate, poly aluminum chloride or poly aluminum silicate.

8. A method as claimed in claim 1, wherein said species is added and mixed with the pulp before said clay particles are added and mixed in the pulp.

9. A method as claimed in claim 1, wherein said species is an inorganic, water-soluble salt of aluminum.

10. A method as claimed in claim 1, wherein the clay is bentonite in association with a water-soluble, highly charged anionic polymer.

11. A method as claimed in claim 1, wherein the species has a molecular weight below 0.5 million.

* * * * *